US008296887B2

(12) United States Patent
Doehler et al.

(10) Patent No.: US 8,296,887 B2
(45) Date of Patent: Oct. 30, 2012

(54) RESILIENT MATERIAL/AIR BLADDER SYSTEM

(75) Inventors: Steven Doehler, Cincinnatti, OH (US); James H. Price, Mount Pleasant, SC (US)

(73) Assignee: Stryker Corporation, Kalamazoo, MI (US)

( * ) Notice: Subject to any disclaimer, the term of this patent is extended or adjusted under 35 U.S.C. 154(b) by 284 days.

(21) Appl. No.: 12/234,818

(22) Filed: Sep. 22, 2008

(65) Prior Publication Data

US 2010/0071137 A1 Mar. 25, 2010

(51) Int. Cl.
*A47C 27/10* (2006.01)

(52) U.S. Cl. ..... 5/710; 5/713; 5/715; 5/732

(58) Field of Classification Search ..... 5/706–715, 5/717, 731, 732

See application file for complete search history.

(56) References Cited

U.S. PATENT DOCUMENTS 5,121,962 A * 6/1992 Weber et al. ..... 297/214
5,142,717 A * 9/1992 Everard et al. ..... 5/709
5,325,551 A 7/1994 Tappel et al.
5,606,754 A 3/1997 Hand et al.
5,794,289 A * 8/1998 Wortman et al. ..... 5/713
5,926,883 A * 7/1999 Rechin et al. ..... 5/706
6,159,172 A * 12/2000 Gray et al. ..... 601/149
6,306,112 B2 10/2001 Bird
6,499,167 B1 12/2002 Ellis et al.
6,554,785 B1 4/2003 Sroufe et al.
6,584,628 B1 7/2003 Kummer et al.
6,598,250 B1 * 7/2003 Pekar ..... 5/654
6,684,433 B2 * 2/2004 Giori et al. ..... 5/709
2006/0101581 A1 * 5/2006 Blanchard et al. ..... 5/713
2006/0168736 A1 8/2006 Meyer et al.
2006/0272097 A1 * 12/2006 Dionne et al. ..... 5/713
2007/0143928 A1 * 6/2007 Biggie et al. ..... 5/715
2008/0271245 A1 * 11/2008 Flick ..... 5/425

* cited by examiner

*Primary Examiner* — William Kelleher
(74) *Attorney, Agent, or Firm* — Warner Norcross & Judd LLP

(57) ABSTRACT

A fluid bladder system has a conventional fluid bladder and a resilient member in the fluid bladder. The resilient member is of a size that it allows the fluid in the fluid bladder to be the principal support applied to the patient. The resilient member only applies a force to the patient only after the patient displaces the fluid in the fluid bladder so the resilient structure is the only entity that inhibits the patient from bottoming out.

20 Claims, 4 Drawing Sheets

RESILIENT MATERIAL/AIR BLADDER SYSTEM

FIELD OF THE INVENTION

The present invention is directed to a fluid bladder mattress system.

BACKGROUND OF THE INVENTION

Inflatable therapeutic supports for patients have been well known for many years. Such therapeutic supports include inflatable mattresses and cushions.

Most therapeutic supports are designed to reduce "interface pressures." Interface pressures are the pressures encountered between the therapeutic support and the skin of a patient positioned on the therapeutic support. It is well known that interface pressures can significantly affect the well-being of immobile patients in that higher interface pressures can (a) reduce local blood circulation, (b) cause bed sores and (c) cause other medical complications. With inflatable mattresses, such interface pressures depend (in part) on the air pressure within the inflatable bladders.

Bladders

Every inflatable therapeutic support has at least one bladder. That bladder has a top surface capable of receiving an object like a patient, a bottom surface that is opposite the top surface, and at least one side surface positioned between the top and bottom surfaces. The bladder surfaces can be a fluid impermeable material, fluid permeable material or combinations thereof depending on the desired application. For example, the bladder material can be a polymeric material, for example, vinyl, polyethylene, polyurethane or combinations thereof. The bladder can be made from a single piece of material or a plurality of materials to obtain the desired results. These various surfaces define a bladder cavity that receives a fluid.

The bladder cavity receives the fluid, normally air or an aqueous solution, through an inlet from a fluid source. The fluid travels from the fluid source through a conduit(s) and the fluid's flow, flow rate, and temperature (those characteristics and others are commonly referred to as therapeutic fluid traits) are normally controlled by a control unit.

The control unit, for example, has a plurality of input keys interconnected to at least a microprocessor. The patient or patient's caregiver essentially controls the therapeutic fluid traits through the input keys. The term input keys means a keyboard system, switches, software chips, levers, dials or any other conventional device that is used as an input device by the patient or patient's caregiver to control the operation of the therapeutic fluid traits.

In the microprocessor embodiment, the microprocessor receives the desired instructions from the input keys. From those instructions, the microprocessor processes those instructions to transmit the desired signals to operate a pump, an air compressor, a heater, a cooler, a fan, valves and/or switches that push, pull and/or allows (by potential energy contained in the bladder(s)) a fluid into, through or to pass into a first conduit(s) to the respective bladder(s) at the desired therapeutic fluid traits. Prior to entering the conduits, the fluid is contained within a heated reservoir, a cooled reservoir, an ambient reservoir, ambient environment and/or combinations thereof; a.k.a., fluid source.

From this fundamental understanding of inflatable bladders, the variations of bladders are evident. For example, some bladders (1) have the inlet removed after the fluid is inserted into the bladder cavity so the bladder is a self-contained, static bladder and (2) retain the inlet so the bladder is a dynamic bladder that can receive and/or release fluid from the bladder cavity.

In the dynamic bladder embodiment, the fluid exits the bladder through at least one outlet. In one version, the fluid exits the outlet (a.k.a., the inlet) through the first conduit to return to the fluid source. In other versions the fluid exits the outlet (not the inlet) through a second conduit to a receiving unit (distinct from the fluid source) or the fluid source. Another version has the surface of the bladder having a plurality of apertures designed to release a portion of the fluid (normally air) toward the object positioned above the inflatable bladder (a.k.a., low-loss bladder). Other outlet versions have combinations of the above-identified outlet versions.

There may be alternative embodiments to these generic descriptions of dynamic bladders and control units. The bladders may have alterations to (1) generate desired fluid flow patterns within the bladder, (2) obtain desired bladder firmness and (3) allow the bladder adaptability for the therapeutic support system. To obtain such results and others like it, the bladders could have predetermined button welds, welds, and slits along welds. Welds are locations where the bladder's top surface is connected to the bladder's bottom surface.

Standard Therapeutic Bladder

One example of a therapeutic patient support system having a therapeutic bladder is disclosed by Hand et al. in expired U.S. Pat. No. 5,606,754. Hand et al. disclose "a . . . patient support system [having] a rigid support frame [and] a plurality of inflatable [bladders] supported upon the support frame with each [bladder] having an upper surface so that the plurality of [bladders form] a patient support surface. The inflatable [bladders] are pressurized and maintained at a predetermined pressure. This predetermined pressure may be a patient height and weight specific pressure profile." It is known that the bladders can be positioned horizontally (a.k.a., perpendicular to a patient properly positioned on the therapeutic support) and/or vertically (a.k.a., parallel to a patient properly positioned on the therapeutic support) in relation to the support frame. This therapeutic patient support system embodiment utilizes a standard therapeutic fluid bladder.

Wave Therapy

When the bladders on a standard support frame are positioned horizontally, the bladders can be divided into at least two sets (1-2-1-2) to provide wave therapy. Wave therapy is accomplished when (a) the first set of bladders receives fluid and, at the same time, the second set of bladders releases fluid; and then (b) the second set of bladders receives fluid and, at the same time, the first set of bladders releases fluid. That process causes a wave sensation under the patient. The wave therapy can occur with additional sets of bladders, for example "1-2-3-4-1-2-3-4", "1-3-2-1-3-2" and variations thereof.

The wave therapy, in one embodiment, is accomplished by (a) the first bladder set interconnects to the control unit through a primary first conduit system; and (b) the second bladder set interconnects to the control unit through a secondary first conduit system. To obtain the desired wave therapy, the control unit positions a valve that transmits fluid to either the primary first conduit system or the secondary first conduit system in predetermined time frames to obtain the wave motion. The control unit can also alter the valve so the primary first conduit system and the secondary first conduit system receive fluid simultaneously if no wave therapy is desired.

Turn-Assist Bladder Therapy

Turn-assist bladder therapy is an obvious variation of a rotating bladder therapy. The rotating embodiment is used to decrease sores on immobile patients. An example of a rotating (turn-assist) therapy is disclosed in U.S. Pat. No. 5,794,289 which is commonly assigned and is hereby incorporated by reference.

In U.S. Pat. No. 5,794,289, Gaymar describes a rotating bladder system 10 having upper and lower right side rotating bladder(s) 12*a,b* and upper and lower left side rotating bladder(s) 14*a,b* positioned below a surface bladder 180. The rotating bladders rotate a patient positioned on the surface bladder by controlling the air pressure in the right set of rotating bladders and the left set of rotating bladders. The right rotating bladder set is inflated and deflated simultaneously; likewise the left rotating bladder set is inflated and deflated simultaneously. This is accomplished by having the bladders 12*a,b* interconnected to the control unit 20 through a first conduit 16 and the bladders 14*a.b* interconnected to the control unit 20 through a second conduit 18 as illustrated in FIGS. 1, 2, and 3.

To rotate a patient 11 to its right side requires decreasing the air pressure in the right set of rotating bladder(s) 12*a,b* while increasing the air pressure in the left side rotating bladder 14*a,b* so the left side is higher than the right side as illustrated in FIGS. 1, 2 and 3.

To rotate the patient to the patient's left side requires decreasing the air pressure in the left side rotating bladder(s) 14*a,b* and increasing the air pressure in the right side rotating bladder 12*a,b*, so it is opposite of what is illustrated in FIGS. 1, 2 and 3.

The air pressure required to rotate the patient depends on the patient's weight, body type and various other parameters. The quantity of air pressure that rotates one patient, e.g., 30 degrees, may rotate another patient, e.g., 5 degrees. For example, two female patients weigh 130 pounds, one patient is pear-shaped and the other is apple-shaped. The pear-shaped patient rotates 15 degrees with 10 mm Hg while an apple-shaped patient rotates 7 degrees with 10 mm Hg. Obviously each patient is unique and different and the control unit has to be controlled to provide the desired rotation for each patient.

As clearly set forth in Hill-Rom's U.S. patent application publication number 2006/0168736, turn-assist bladders and rotational bladders are essentially synonymous—"a turn-assist cushion or turning bladder or rotational bladder 74 . . . ." If there is a difference between a turn-assist bladder and a rotation bladder, the difference is in the software used in the control unit. In the rotation bladder embodiment, the control unit (1) has the bladders in a set position—planar which can be completely deflated or just partially inflated, (2) rotates the patient, through the bladders, in a first direction by inflating one set of rotating bladders (for example the right set), (3) reverts the bladders to the set position, (4) rotates the patient, through the bladders, in a second direction by inflating the other set of rotating bladders (for example the left set) and (5) reverts to the set position. The turn-assist bladder embodiment, in contrast, eliminates the third step. Accordingly, it seems relatively obvious that the technology for the turn-assist embodiment is an obvious variation of the rotation bladder embodiment by merely altering the software used in the control unit so the bladders are rotated from a first direction to a second direction without the intermediate step of reverting to a set position.

In the prior art and as previously described above, the upper section and the lower section for each right and left set of rotational (or turn-assist) bladders are inflated at the same time to obtain the desired rotation. Moreover, the rotational (or turn-assist) bladders are positioned below other bladders or other cushion materials. See FIG. 11 (rotational bladders 184, 188 are under cushion 180) in U.S. Pat. No. 5,794,289; FIGS. 17 to 19 (rotational bladders 145, 146, 147, 148 are under cushion 182) in U.S. Pat. No. 6,584,628; FIG. 3 (rotational bladders 80 are below cushion 60) in U.S. patent application publication number 2006/0168736; and FIG. 4 (rotational bladders 110 are positioned below cushions 33) in U.S. Pat. No. 6,499,167. In other words, the rotating (turn-assist) bladders are positioned below another cushion which the patient is designed to be positioned upon.

Like the standard bladder therapy system, the rotating bladder therapy system can also provide wave therapy. In most embodiments, the wave therapy, on a rotating bladder therapy system, occurs when (1) the rotating bladders are in the set position—generally planar—and (2) the wave therapy bladders are positioned above the rotating bladders. The wave therapy bladders are not the same as the rotating (turn-assist) bladders. Rotating (turn-assist) bladders do not perform wave therapy. One reason wave therapy is not performed by the rotating bladders is because the rotating bladders are positioned below another bladder.

Software Means to Inhibit Bottoming Out

Programming an air pressure cushion unit requires a skilled technician. The skilled technician analyzes each patient and alters the programming to attain the desired air pressure. One method to avoid the expensive technician's analysis and re-programming is to create a self-monitoring mattress.

Previous self-monitoring air pressure cushions have utilized electrical signal transmission devices and electrical signal receiving devices. In one embodiment, the transmission device is a part of the top surface of a bladder and the receiving device is a part of the bottom surface of the bladder. That means the transmission and receiving devices are separated by a bladder cavity. By monitoring the duration of the signal from the transmitter to the receiver, the operator can monitor the size of the bladder. The size of the bladder corresponds to the air pressure and, it desired, the rotation of the patient. Such signal devices are disclosed in U.S. Pat. No. 5,794,289. Those signal devices generate electrical signals, like rf signals, that may, however, adversely effect other medical equipment. In particular, Wortman et al. disclosed (without reference numbers):

[There] is illustrated an inflatable cushion which is shown to be similar to cushion but may be any other suitable inflatable cushion. The cushion is provided with button welds to prevent ballooning thereof. The cushion has upper and lower surfaces. Cushion inflation is related to the distance between the upper and lower surfaces.

In order to prevent bottoming-out from occurring and to more precisely regulate the cushion inflation, the cushion is inflated so that the distance between the upper and lower surfaces is a predetermined distance. A transmitter coil and a receiver coil are provided adjacent the upper and lower surfaces, and the distance there between is related to the signal strength of a signal transmitted there between. Alternatively, the coil may be provided adjacent the lower surface, and the coil provided adjacent the upper surface.

In any case, those Gaymar patents illustrate that controlling the air in a cushion is desirable to prevent bottoming and prevent excess pressure being applied to the patient. "Bottoming" refers to any state where the upper surface of any given cushion is depressed to a point that it contacts the lower surface, thereby markedly increasing the interface pressure where the two surfaces contact each other. Prior to bottoming occurring, the pressure exerted by the bladder on the skin of the object becomes excessive. Those bottoming sensors are acceptable but Gaymar has been seeking to improve such sensors and/or eliminate them. The improvements are made for numerous reasons. Some of these reasons are and not limited to cost, reliability, easiness or difficulty to install and adjust the system, and simplicity. In addition, the bottoming sensor should be able to diminish the chance of bottoming out and also decrease the chance that the cushion will exert too much pressure to the patient.

Currently, rotating bladders are positioned below other bladders. That "other bladder over the rotating bladder" embodiment decreases the rotating bladders' efficiency of providing the desired rotation therapy. Merely removing the other bladder causes other problems for example bottoming out. The bottoming out problem with rotating bladders has been previously discussed above. The bottoming out issue remains a problem when the other bladders are removed to maximize the rotating bladder's therapy efficiency. Moreover, positioning bladders or other resilient materials (foam or gelastic material) below the rotating bladders is not desired because the rotating bladders are positioned over a non-secure, non-rigid material.

Foam Filled Bladder

A different bladder embodiment is disclosed by Stryker's U.S. Pat. No. 5,325,551. In the '551 patent, Stryker disclosed a bladder completely filled with foam having apertures and the air circulates through those apertures. Stryker wrote (without reference numbers), "An inflatable air bladder of generally rectangular shape rests on the bottom sheet between the side elements [of a mattress] so that three sides of the air bladder engage the respectively concave surfaces [of the mattress]. The vertical thickness of the air bladder is substantially equal to the vertical thicknesses of side elements and head element [of the mattress]. The end of the air bladder remote from element is approximately flushly aligned with the adjacent end surfaces of the side elements. The internal construction of the air bladder is described in more detail later. Two air hoses each communicate with the interior of the air bladder at opposite corners of the end nearest the foot end of the mattress. The air hoses have at the outer ends thereof respective conventional connector elements . . . . The foam elements are somewhat stiffer than the pressurized bladder, and thus serve as a frame which helps to keep a patient centered on the bladder. Also, after giving a hypodermic injection, hospital personnel sometimes insert the needle temporarily into a mattress while completing other tasks. In the preferred embodiment, the six inch horizontal width of foam elements and the two inch vertical thickness of foam sheets [positioned over the bladders] protect against puncture of the bladder in the event a hypodermic needle is inserted into the mattress unit . . . . The air bladder is filled by a foam sheet which is of generally rectangular shape. In the preferred embodiment, the foam sheet has an ILD for the foam material itself which is less than 15 lbs. The foam sheet has above it an upper sheet and has below it a lower sheet. In the preferred embodiment, the [foam] sheets are made of polyurethane-coated nylon. The [foam] sheets are bonded in a conventional manner to the surfaces of the foam core, and along the peripheral edges of the foam core the [foam] sheets are bonded to each other in a conventional manner . . . . The foam core has a plurality of horizontal cylindrical holes extending transversely therethrough. The holes soften the [foam] sheet, and also facilitate rapid air movement within the bladder so that pressure equilibrium is quickly restored after a change. It should be noted that the spacing between adjacent holes is, for the four holes at the head end of the bladder and the three holes at the opposite end, approximately half the spacing between adjacent holes in the center region of the bladder. The holes increase the softness of the air bladder, and in particular can be used to give the foam sheet an effective ILD value which is less than the rated ILD value of the material of the foam sheet when no holes are present, and in fact the provision of holes allows the foam sheet to be given an effective ILD value which is less than the lowest ILD foam material readily available on the commercial market. By varying the spacing between adjacent holes in different portions of the foam sheet . . . respective portions of the foam sheet can be given different effective ILD values. In the preferred embodiment, the holes are all of uniform diameter and the spacing between adjacent holes is varied, but it will be recognized that an equivalent result can be achieved by varying the diameters of the holes while maintaining a uniform spacing between adjacent holes, or by varying both the diameters and the spacing. Also, of course, the effective ILD of the foam can be relatively uniformly reduced by using uniformly spaced holes of equal diameter. The result is that different portions of the bladder will exhibit different stiffness properties even though the same air pressure is present throughout the bladder." (Bolded words for emphasis.) A problem with that embodiment is that the foam is really the cushion material, not the air in the bladder. It is preferred that the fluid in the air bladder be the principal source of pressure applied to the patient, not the foam. Moreover, a bladder filled with foam is unable to be a rotating bladder or a wave bladder since the foam does not expand with air.

Air Bladder and Gel Material Cushion

In U.S. Pat. No. 6,554,785; Sroufe et al. wrote, "An orthopedic device of a therapeutic nature which includes an air bladder and an overlying gel bladder. The air and gel bladders are joined and are secured within a retainer which is adapted to be placed about a body part of a patient with the air or gel bladder being positioned next to the body part." The gel bladder is positioned over the air bladder so the gel bladder is the principal bladder that contacts the patient.

In U.S. Pat. No. 6,306,112; Bird wrote, "A therapeutic ankle support brace bladder pad member having a pair opposed surfaces defining an inflated air support pocket and a second support pocket containing gel material and filler apparatus materials, is disclosed. An overlay fabric material is integrally attached to the bladder, provides additional support and enables removable attachment of the bladder to side support members of a therapeutic brace." That means the air bladder contacts first portion of a patient and gel bladder contacts a second portion of the patient.

In U.S. Pat. Nos. 6,306,112 and 6,554,785, the inventors fail to disclose a dynamic air bladder or a resilient member in a dynamic air bladder or equivalents thereof. Instead the inventors concentrate on applying the desired gel cushion characteristics to one part of a patient's body and air cushion characteristics to a second part of a patient's body.

Those problems are solved by the current invention that is disclosed in the present application.

SUMMARY OF THE INVENTION

A fluid bladder system has a conventional fluid bladder and a resilient member in the fluid bladder. The resilient member is of a size that it allows the fluid in the fluid bladder to be the principal support applied to the patient. The resilient member only applies a force to the patient only after the patient displaces the fluid in the fluid bladder so the resilient structure is the only entity that inhibits the patient from bottoming out.

DETAILED DESCRIPTION OF THE INVENTION

Figure 1:
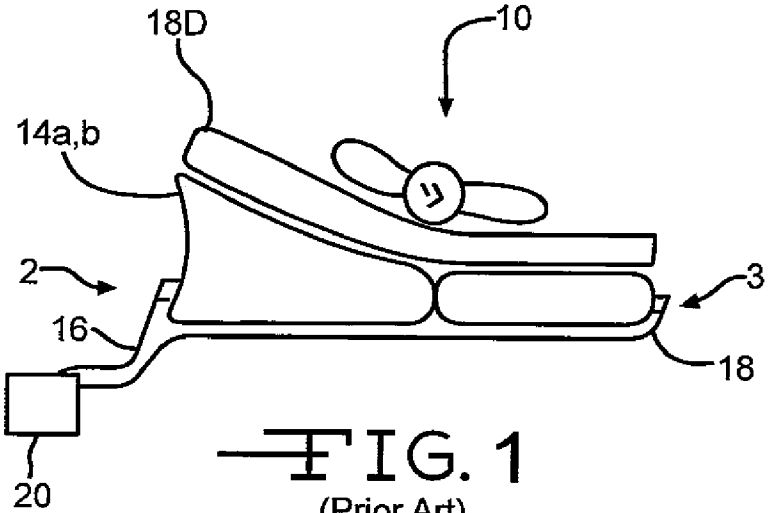
FIG. 1 (Prior Art)
FIG. 1 illustrates a patient positioned over rotating bladders of a therapeutic support from a head end of the rotating bladders—Prior Art.
Figure 2:
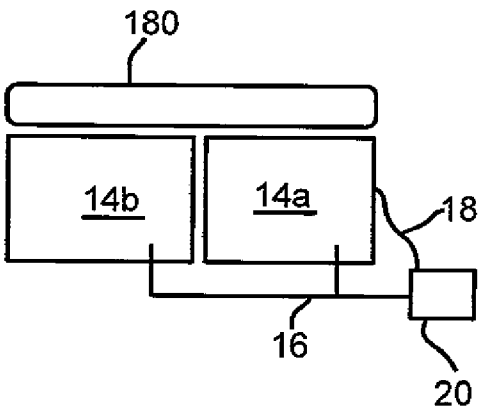
FIG. 2 (Prior Art)
FIG. 2 illustrates FIG. 1 from arrow 2—Prior Art.
Figure 3:
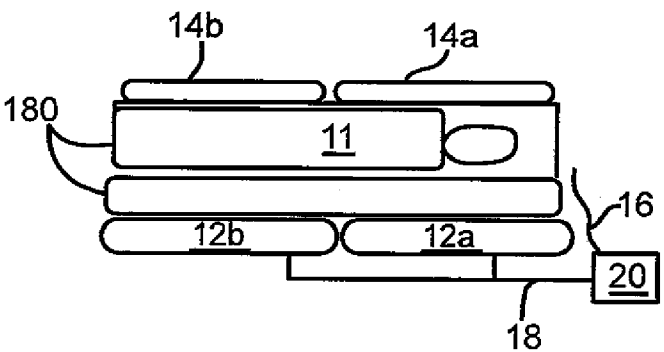
FIG. 3 (Prior Art)
FIG. 3 illustrates FIG. 1 from arrow 3—Prior Art.

The present invention is directed to a variation of a bladder that can be used as a static bladder and/or preferably a dynamic bladder to provide support, wave therapy, a rotational (turn-assist) therapy, percussion therapy, access ability, or variations and combinations thereof. To merely illustrate the present bladder invention, we will concentrate on the rotational (turn-assist) support system 110 as an example.

The present rotational (turn-assist) support system 110 is similar to the prior art rotational (turn-assist) support system 10. One of the similarities is that the rotational (turn-assist) bladders 122, 124, 132, 134 are positioned on a rigid, secure support surface 102. The support surface 102 can be a part of a rigid and secure mattress, a rigid, secure foam surface, a solid surface or any other location that provides support to a patient. The variations are in the rotational (turn-assist) bladder 122, 124, 132, 134 and possibly, in certain embodiments, the control unit 210. The rotational (turn-assist) bladder system 110 can extend the entire length of the support surface 102 as illustrated in FIG. 5 or just partially as illustrated in FIG. 6.

Figure 4:
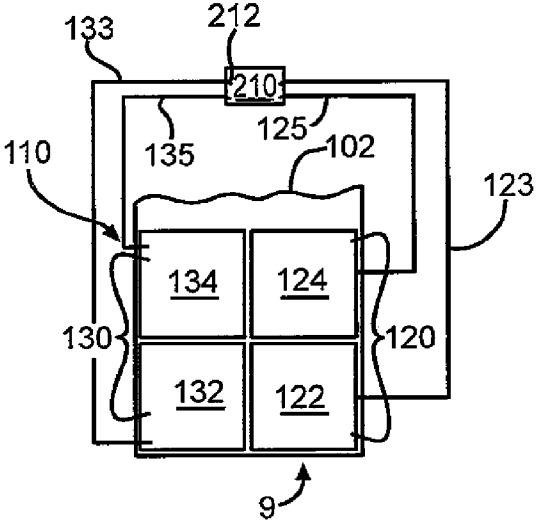
FIG. 4 illustrates a top view of rotational (turn-assist) bladders (a) on a support surface and (b) interconnected to a control unit.

As illustrated in FIG. 4, the rotational (turn-assist) bladder system 110 has a right side bladder unit 120 and a left side bladder unit 130. The right side bladder unit 120 is subdivided into at least a first right section 122 and a second right section 124. Likewise, the left side bladder unit 130 is subdivided into at least a first left section 132 and a second left section 134.

Figure 5:
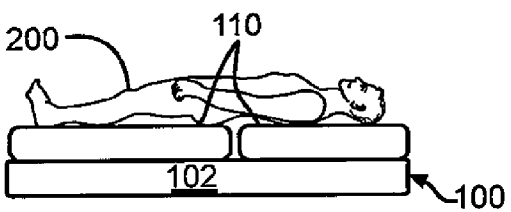
FIG. 5 illustrates a side view of rotational (turn-assist) bladders on a support surface.
Figure 6:
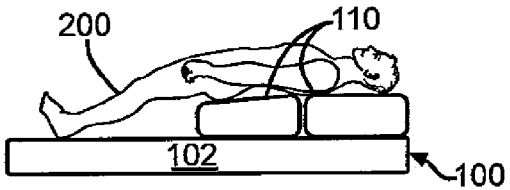
FIG. 6 illustrates an alternative embodiment of FIG. 5.
Figure 7:
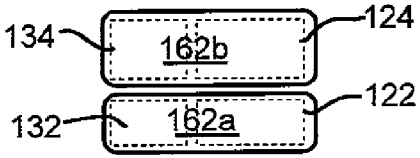
FIG. 7 illustrates an alternative embodiment of FIG. 4 with additional cushions positioned over opposing left-right rotational (turn-assist) bladders.
Figure 13:
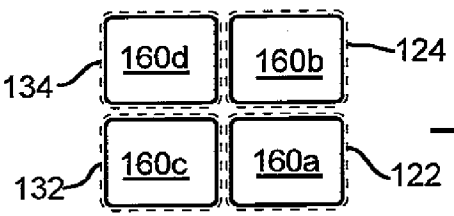
FIG. 13 illustrates an alternative embodiment of FIG. 7.

Unlike the prior art, the rotational (turn-assist) bladder system 110 can be positioned immediately below a patient 200, as illustrated at FIGS. 5 and 6, without any intervening cushion that interferes with the operation of the rotational therapy. There is no single cushion material that must overlay the entire rotational (turn-assist) bladder system 110 or an entire bladder unit 120, 130 because that would violate the fundamental basis of the present invention. Instead there can be (a) optional individual cushions 160*a, b, c, d* (bladders, gelastic material (a honey-comb tri-block A-B-A copolymer composition) and/or foam material) positioned over bladders sections 122, 124, 132, 134 as illustrated in FIG. 13 or (b) cushions 162*a, b* that extend across pairs of opposing left-right bladders sections, like sections 122 and 132 or sections 124 and 134 as illustrated in FIG. 7.

There can be optional covers, blankets (conventional, conductive and/or convective) and/or pads (incontinence, heating, cooling, and/or positioning), not shown, positioned between the patient 200 and the rotational (turn-assist) bladder system 110.

Figure 14A:
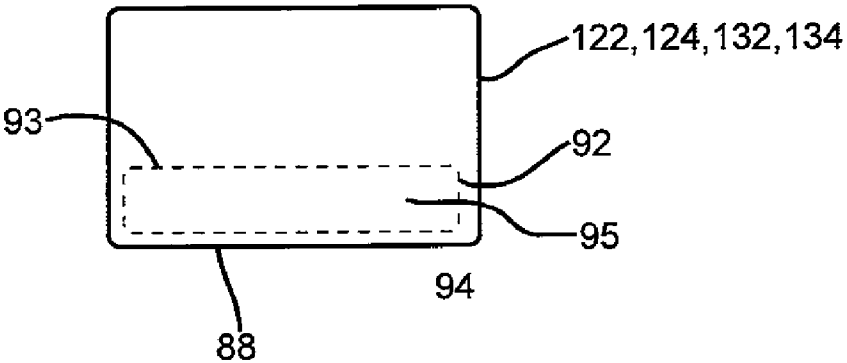
FIG. 14 illustrates an alternate version of FIG. 9*a*.
Figure 14B:
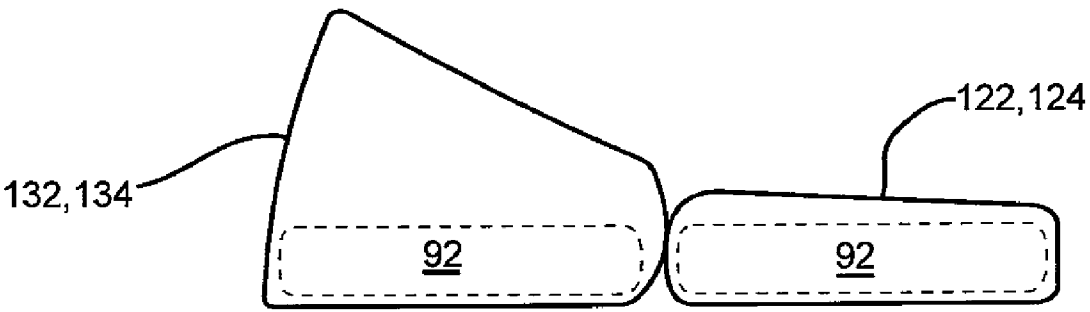

Within each bladder 122, 124, 132, 134 and as illustrated in FIGS. 14*a,b* is a resilient structure 92. The resilient structure 92 is a conventional foam material. The resilient structure 92 has a top surface 93, a bottom surface 94 and a side surface 95 having a predetermined height. The bottom surface 94 contacts the bladder's bottom surface 88. The predetermined height is equal to a height that inhibits the patient from contacting the bladder's bottom surface. That predetermined height ranges from being (a) not contacting the height of the inflated bladder in the set (normal inflation) position (FIG. 14*a*) to (b) a height above the bladder's bottom surface 88 so the patient does not bottom out with the desired resilient structure. The size and position of the resilient structure 92 does not interfere with the normal operation of the bladder and preferred bladder fluid forces applied to the patient. Instead the size and position of the resilient structure 92 is utilized only when the fluid is compressed and/or moved so there is little to no fluid between the patient and the resilient structure. In a preferred operation, the patient will not contact the resilient structure 92, however, Gaymar has realized that technicians do not always account for various patient weights and shapes that may cause the patient to bottom out. Thereby, the resilient structure decreases the chance the patient bottoms out especially when the bladders are performing rotation (turn-assist) therapy (see FIGS. 14*b* and 9*a*), wave therapy, percussion therapy, and/or access therapy, which will be explained in greater detail below.

In a preferred embodiment the resilient structure 92 extends the width of the bladder, but it can be a shorter width depending on where the patient is most likely to be bottomed out during the respective therapy. The resilient structure 92 can be a foam, a gelastic surface (see U.S. Pat. No. 7,076,822 to Pearce and U.S. Pat. No. 6,767,621 to Flick [commonly assigned], which are hereby incorporated by reference), and a resilient structure enclosed in a bladder material (identified above).

As illustrated in FIG. 4, the first right side bladder unit 122 interconnects to the control unit 210 through a first right conduit 123 and the second right side bladder unit 124 interconnects to the control unit 210 through a second right conduit 125. The control unit 210 distributes the desired amount of fluid to each right bladder unit 122, 124. Likewise, the first left side bladder unit 132 interconnects to the control unit 210 through a first left conduit 133 and the second left side bladder unit 134 interconnects to the control unit 210 through a second right conduit 135. The control unit 210 distributes the desired amount of fluid to each left bladder unit 132, 134 through the respective conduit. This embodiment is also not described, suggested or taught in the prior art because the prior art discloses that the bladder units 122, 124 or 132, 134 are to inflate simultaneously through the same conduits, not different conduits.

Figure 8:
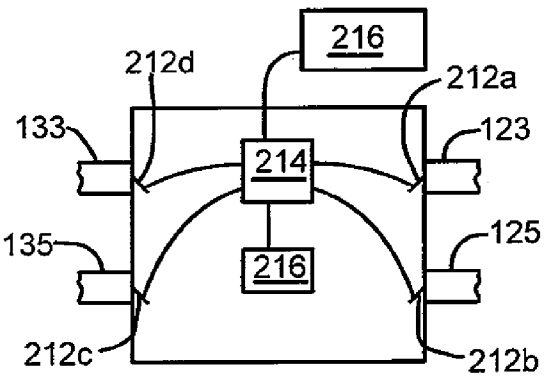
FIG. 8 illustrates a schematic of the control unit.

The principle of how the control unit 210, as illustrated schematically at FIG. 8 distributes fluid to different conduits and not to other conduits, or all of them is similar to the prior art. Instead, there are just more valves 212*a,b,c,d* interconnected to a microprocessor 214 that correspond to the respective conduits 123, 125, 133, 135 to obtain the desired operation of the present invention.

Recall that the control unit 210, for example, has a plurality of input keys 216 interconnected to at least the microprocessor 214. That microprocessor 214 interconnects to pumps, coolers, heaters, fans, valves and/or switches (collectively box 216) that push, pull and/or allows (by potential energy contained in the bladder(s)) a fluid into, through or pass into the conduit(s) 123, 125, 133, 135 to the respective bladder(s) 122, 124, 132, 134. Prior to entering the conduits, the fluid is contained within a reservoir and/or ambient environment; a.k.a., fluid source. The fluid source can be within the control unit 210 or exterior to the control unit 210. Likewise the input keys 216 can be a part of the control unit 210, tethered to the control unit 210 or remotely interconnected to the control unit 210.

The control unit 210 can be positioned within the support system 100 or exterior to it. It depends on how the product is to be designed.

Operation of the Product for Rotation/Access Therapy:

For this example, we will assume the patient will be initially turned to the left side. Obviously, the patient can be turned to the right side first, as well. It merely depends on (1) which side the patient wants to be positioned on first and/or (2) how the patient's assistant (including and not limited to a nurse, a nurse practitioner, a nurse's aide, an aide, a friend, and/or a family member), who can control the support surface, wants the patient to be positioned first.

Figure 10:
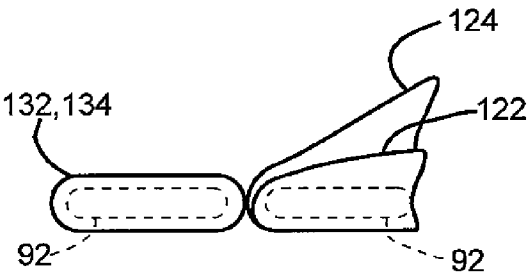
FIG. 10 illustrates an alternative embodiment to accomplish FIGS. 9*a* and 9*b*.
Figure 9A:
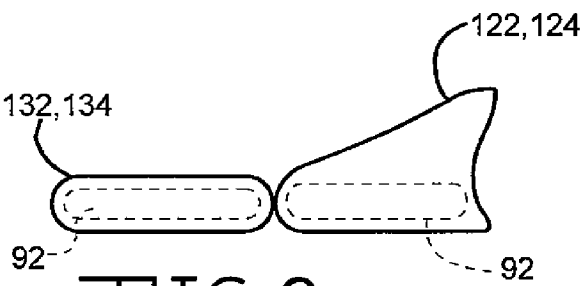
FIG. 9*a* illustrates a side view of FIG. 4 taken from arrow 4 when the right rotational (turn-assist) bladders are being inflated simultaneously.

The first right section 122 and the second right section 124 are inflated at the same time (same as the prior art) as illustrated in FIG. 9*a* or at different rates or times, as illustrated in FIG. 10 (not the same as the prior art), to obtain the desired angle. The sections 122 and 124 can be inflated at different times and/or rates because (1) each section 122, 124 is interconnected to the control unit 210 through different conduits and (2) the patient's assistant (or the manufacturer) can program the control unit through the microprocessor and/or input keys to open the valves to conduits 213, 215 at different times or with different apertures to control the inflation rate.

Figure 9B:
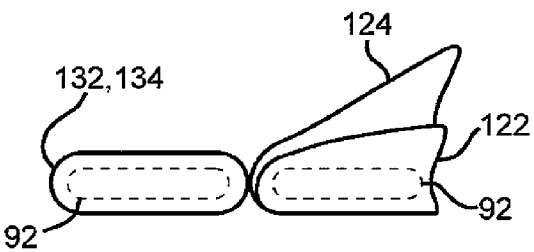
FIG. 9*b* illustrates an embodiment of FIG. 9*a* when the second right rotational (turn-assist) bladder remains inflated and the first right rotational (turn-assist) bladder deflates to expose a first portion of the patient that normally contacts the right rotational (turn-assist) bladder so a patient's assistant can care and treat the patient at the first portion without excessively disturbing the patient.

In a first embodiment, once the patient is properly rotated (turned) to the desired angle with both bladders 122, 124 (as illustrated in FIG. 9*a*) inflated for rotation (turning) purposes, the patient may displace the fluid in the non-rotating bladders (as illustrated in FIG. 9—132 and 134) because a large proportion of the patient's weight when rotated is directed onto the non-rotating bladders 132 and 134. The resilient structures 92 in the non-rotating bladders (132 and 134) inhibit the patient from bottoming out. Once the patient is inhibited from bottoming out, the patient's assistant can begin to deflate one of the inflated and rotated (turned) sections 122, 124. For purposes of this example as illustrated in FIG. 9*b*, the section 122 is initially deflated. Why begin to deflate just one of the inflated and rotated sections? That way, the patient's assistant exposes a predetermined area (examples include and are not limited to the right side of the sacral region, the thoracic region, the lumbar region, the cervical region, the abdominal area, and/or the chest area) of the patient that normally contacts the section 122. Deflating the respective current rotating section 122 while maintaining the rotation angle of the other current rotating section 124 greatly enhances the patient's assistant ability to wash, treat, inspect the initial predetermined area of the patient, without the using props (pillows typically) or additional patient's assistants to hold the patient in position. This invention comforts the patient.

Figure 9C:
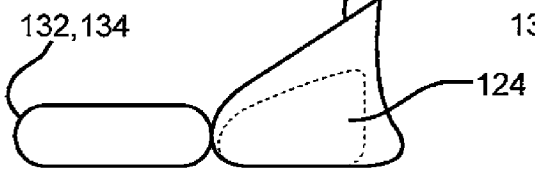
FIG. 9*c* illustrates an embodiment of FIG. 9*a* when the first right rotational (turn-assist) bladder is inflated and the second right rotational (turn-assist) bladder deflates to expose a second portion of the patient that normally contacts the right rotational (turn-assist) bladder so a patient's assistant can care and treat the patient at the second portion without excessively disturbing the patient.
Figure 11:
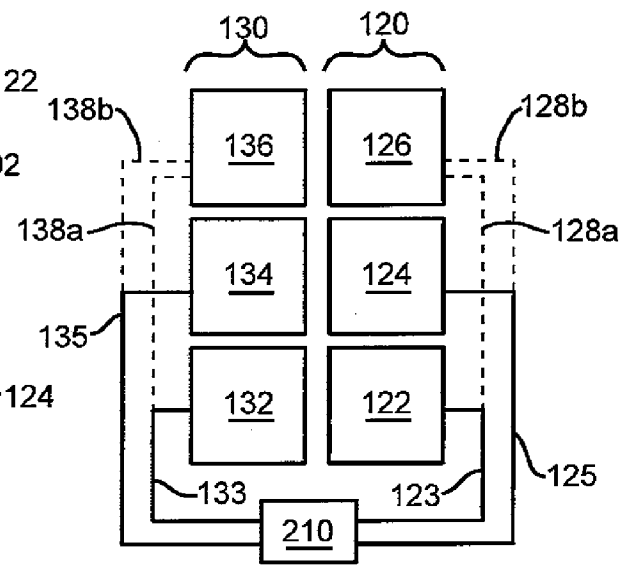
FIG. 11 illustrates an alternative embodiment of FIG. 4.
Figure 12:
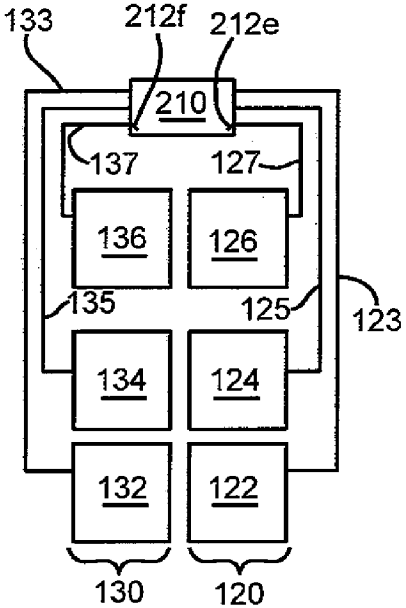
FIG. 12 illustrates an alternative embodiment of FIG. 4.

Once the patient's assistant is completed caring and treating the initial predetermined area, the section 122 is inflated to the desired rotation level and the section 124 can be deflated to expose a second predetermined area of the patient as illustrated in FIG. 9*c*. Deflating the section 124 greatly enhances the patient's assistant ability to wash, treat, inspect the second predetermined area of the patient, without the using props (pillows typically) or additional patient's assistants to hold the patient in position.

Alternatively, when the section 122 is being inflated the section 124 can be simultaneously deflated to expedite the transition process.

It does not matter which section 122, 124 is deflated first or second in this first embodiment, so long as the patient's assistant has the opportunity to expose a predetermined area to care and treat the patient while the patient remains in the rotated position.

A second embodiment occurs when the sections 122, 124 are being inflated at different times or different rates as illustrated in FIG. 10. The section that is being inflated at the slower rate or at a later time (hereinafter "slow section") inherently exposes a first predetermined area to the patient's assistant as shown in FIGS. 9*b* and 9*c*. That way the patient's assistant can wash, treat, inspect the predetermined area of the patient, without the using props (pillows typically) or additional patient's assistants to hold the patient in position. Once the slow section is fully inflated to the desired rotation (or turning) the fast section can be deflated so the patient's assistant can care and treat a different predetermined area of the patient.

Alternatively, when the slow section is being inflated the fast section can be simultaneously deflated to expedite the transition process.

A third embodiment occurs when the patient is rotated to the right side so sections 132 and 134 are inflated for rotation purposes. This third embodiment is the same as the first and second embodiments except the sections are on the opposite side of the support surface.

Horizontal/Vertically

The bladder sections 122, 124, 126, 132, 134, 136 can be positioned horizontally and/or vertically as defined above.

Self-Monitoring

Programming an air pressure mattress unit requires a skilled technician. The skilled technician analyzes each patient and alters the programming to attain the desired rotation and air pressure. One means to avoid the expensive technician's analysis and re-programming is to create a self-monitoring mattress.

Previous self-monitoring air pressure mattresses have utilized electrical signal transmission devices and electrical signal receiving devices that sandwich the top and bottom of each bladder to monitor the bladder size. The bladder size corresponds to the desired rotation and air pressure. Such signal devices are disclosed in commonly assigned U.S. Pat. Nos. 5,794,289 and 5,926,883; which are hereby incorporated by reference. Those signal devices generate signals, like rf or light signals, that determine the proper level of inflation in the rotating (turning) bladders.

Conduits

The conduits can be conventional tubing used in the therapeutic industry. The conduits can have additional valves like a one-way passage valve.

It is intended that the above description of the preferred embodiments of the structure of the present invention and the description of its operation are but one or two enabling best mode embodiments for implementing the invention. Other modifications and variations are likely to be conceived of by those skilled in the art upon a reading of the preferred embodiments and a consideration of the appended claims and drawings. These modifications and variations still fall within the breadth and scope of the disclosure of the present invention.

We claim:

1. A therapeutic support comprising a rotational (turn-assist) bladder system and a control unit;

the rotational (turn-assist) bladder system has a right side bladder component and a left side bladder component positioned on a support surface;

the right side bladder component has (I) a first right section with a first right resilient structure (a) positioned on the first right section's bottom surface and (b) has a height that (i) allows the fluid in the first right section to be the primary patient support in the first right section wherein the right side bladder contacts the patient directly or through a non-supporting layer, and (ii) inhibits a patient from bottoming out only when the patient's weight displaces the first right section's fluid from being positioned between the patient and the support surface; and (II) a second right section with a second right resilient structure (a) positioned on the second right section's bottom surface and (b) has a height that (i) allows the fluid in the second right section to be the primary patient support in the second right section wherein the right side bladder contacts the patient directly or through a non-supporting layer and (ii) inhibits a patient from bottoming out only when the patient's weight displaces the second right section's fluid from being positioned between the patient and the support surface: and the left side bladder component has (I) a first left section with a first left resilient structure (a) positioned on the first left section's bottom surface and (b) has a height that (i) allows the fluid in the first left section to be the primary patient support in the first left section wherein the left side bladder contacts the patient directly or through a non-supporting layer, and (ii) inhibits a patient from bottoming out only when the patient's weight displaces the first left section's fluid from being positioned between the patient and the support surface; and (II) a second left section with a second left foam section (a) positioned on the second left section's bottom surface and (b) has a height that (i) allows the fluid in the second left section to be the primary patient support in the second left section wherein the left side bladder contacts the patient directly or through a non-supporting layer, and (ii) inhibits a patient from bottoming out only when the patient's weight displaces the second left section's fluid from being positioned between the patient and the support surface.

2. The therapeutic support of claim 1, further comprising:

the first right section interconnects to the control unit through a first right conduit and the second right section interconnects to the control unit through a second right conduit;

the first left section interconnects to the control unit through a first left conduit and the second left section interconnects to the control unit through a second left conduit;

the control unit pushes, pulls and/or allows a fluid into, through or pass into (a) the first left conduit to the first left section, (b) the second left conduit to the second left section, (c) the first right conduit to the first right section and/or (d) the second right conduit to the second right section;

the control unit has (a) a first left valve that controls (i) when the fluid enters the first left conduit, (ii) the amount of fluid that enters the first left conduit and (iii) the rate the fluid enter the first left conduit, (b) a second left valve that controls (i) when the fluid enters the second left conduit, (ii) the amount of fluid that enters the second left conduit and (iii) the rate the fluid enter the second left conduit, (c) a first right valve that controls (i) when the fluid enters the first right conduit, (ii) the amount of fluid that enters the first right conduit and (iii) the rate the fluid enter the first right conduit; and (d) a second right valve that controls (i) when the fluid enters the second right conduit, (ii) the amount of fluid that enters the second right conduit and (iii) the rate the fluid enter the second right conduit;

wherein the first right section and the second right section can be (a) inflated at (i) the same pressure level or different pressure levels, (ii) the same inflation rate or different inflation rates and/or (iii) the same time or different times; and/or (b) deflated at (i) the same time or different times, (ii) the same inflation rate or different inflation rates and/or (iii) the same pressure level or different pressure levels to allow a patient assistant to have access to and to provide care and/or treatment to a particular patient's body part that is positioned over the first right section or the second right section when the first right section or the second right section are inflated to rotate (turn) the patient and the other right section is (a) being inflated, (b) deflated or (c) being deflated;

wherein the first left section and the second left section can be (a) inflated at (i) the same pressure level or different pressure levels, (ii) the same inflation rate or different inflation rates and/or (iii) the same time or different times; and/or (b) deflated at (i) the same time or different times, (ii) the same inflation rate or different inflation rates and/or (iii) the same pressure level or different pressure levels to allow a patient assistant to have access to and to provide care and/or treatment to a particular patient's body part that is positioned over the first left section or the second left section when the first left section or the second left section are inflated to rotate (turn) the patient and the other left section is (a) being inflated, (b) deflated or (c) being deflated.

3. The therapeutic support of claim 1 wherein the control unit has an input system that allows a patient and/or patient assistant to control the first left valve, the second left valve, the first right valve, and the second right valve.

4. The therapeutic support of claim 3 wherein the control unit has a microprocessor, and the microprocessor is interconnected between (i) the input system and (ii) the first left valve, the second left valve, the first right valve, and the second right valve.

5. The therapeutic support of claim 1 wherein the rotational (turn-assist) bladder system uses low air loss bladders.

6. The therapeutic support of claim 1 wherein each resilient structure is selected from the group consisting of foam, gelastic material, foam in a bladder material, gelastic material in a bladder material or combinations thereof.

7. The therapeutic support of claim 1 further comprising a third right section wherein the third right section is interconnected to the control unit through an extension of the first right conduit or an extension of the second right conduit.

8. The therapeutic support of claim 1 further comprising a third right section wherein the third right section is interconnected to the control unit through a third right conduit.

9. The therapeutic support of claim 1 wherein the first right section and the second right section are horizontal in relation to the therapeutic support.

10. The therapeutic support of claim 1 wherein the first right section and the second right section are vertical in relation to the therapeutic support.

11. The therapeutic support of claim 1 wherein the first right section and the second right section extend the entire length of the therapeutic support.

12. The therapeutic support of claim 1 wherein the first right section and the second right section extend the partially along length of the therapeutic support.

13. The therapeutic support of claim 1 further comprising cushion material positioned over each individual right and/or left sections (a) first left and right sections or (b) second left and right sections.

14. The therapeutic support of claim 13 wherein the cushion material is selected from a static bladder, wave therapy bladders, gelastic material, foam, and combinations thereof.

15. The therapeutic support of claim 1 wherein the support surface is a mattress.

16. The therapeutic support of claim 1 wherein the support surface is a hospital bed frame.

17. The therapeutic support of claim 1 wherein the control unit is within the rotational (turn-assist) bladder system.

18. The therapeutic support of claim 1 wherein the control unit is exterior to the rotational (turn-assist) bladder system.

19. A method of treating a patient comprising:

positioning a patient on a therapeutic support having a rotational (turn-assist) bladder system and a control unit;

the rotational (turn-assist) bladder system has a right side bladder component and a left side bladder component;

the right side bladder component has (I) a first right section with a first right resilient structure (a) positioned on the first right section's bottom surface and (b) has a height that (i) allows the fluid in the first right section to be the primary patient support in the first right section wherein the right side bladder contacts the patient directly or through a non-supporting layer, and (ii) inhibits a patient from bottoming out only when the patient's weight displaces the first right section's fluid from being positioned between the patient and the support surface; and (II) a second right section with a second right resilient structure (a) positioned on the second right section's bottom surface and (b) has a height that (i) allows the fluid in the second right section to be the primary patient support in the second right section wherein the right side bladder contacts the patient directly or through a non-supporting layer and (ii) inhibits a patient from bottoming out only when the patient's weight displaces the second right section's fluid from being positioned between the patient and the support surface; and the left side bladder component has (I) a first left section with a first left resilient structure (a) positioned on the first left section's bottom surface and (b) has a height that (i) allows the fluid in the first left section to be the primary patient support in the first left section wherein the left side bladder contacts the patient directly or through a non-supporting layer, and (ii) inhibits a patient from bottoming out only when the patient's weight displaces the first left section's fluid from being positioned between the patient and the support surface; and (II) a second left section with a second left foam section (a) positioned on the second left section's bottom surface and (b) has a height that (i) allows the fluid in the second left section to be the primary patient support in the second left section wherein the left side bladder contacts the patient directly or through a non-supporting layer, and (ii) inhibits a patient from bottoming out only when the patient's weight displaces the second left section's fluid from being positioned between the patient and the support surface;

the first right section interconnects to the control unit through a first right conduit and the second right section interconnects to the control unit through a second right conduit;

the first left section interconnects to the control unit through a first left conduit and the second left section interconnects to the control unit through a second left conduit;

the control unit pushes, pulls and/or allows a fluid into, through or pass into (a) the first left conduit to the first left section, (b) the second left conduit to the second left section, (c) the first right conduit to the first right section and/or (d) the second right conduit to the second right section;

the control unit has (a) a first left valve that controls (i) when the fluid enters the first left conduit, (ii) the amount of fluid that enters the first left conduit and (iii) the rate the fluid enter the first left conduit, (b) a second left valve that controls (i) when the fluid enters the second left conduit, (ii) the amount of fluid that enters the second left conduit and (iii) the rate the fluid enter the second left conduit, (c) a first right valve that controls (i) when the fluid enters the first right conduit, (ii) the amount of fluid that enters the first right conduit and (iii) the rate the fluid enter the first right conduit; and (d) a second right valve that controls (i) when the fluid enters the second right conduit, (ii) the amount of fluid that enters the second right conduit and (iii) the rate the fluid enter the second right conduit;

wherein the first right section and the second right section can be (a) inflated at (i) the same pressure level or different pressure levels, (ii) the same inflation rate or different inflation rates and/or (iii) the same time or different times; and/or (b) deflated at (i) the same time or different times, (ii) the same inflation rate or different inflation rates and/or (iii) the same pressure level or different pressure levels to allow a patient assistant to have access to and to provide care and/or treatment to a particular patient's body part that is positioned over the first right section or the second right section when the first right section or the second right section are inflated to rotate (turn) the patient and the other right section is (a) being inflated, (b) deflated or (c) being deflated;

wherein the first left section and the second left section can be (a) inflated at (i) the same pressure level or different pressure levels, (ii) the same inflation rate or different inflation rates and/or (iii) the same time or different times; and/or (b) deflated at (i) the same time or different times, (ii) the same inflation rate or different inflation rates and/or (iii) the same pressure level or different pressure levels to allow a patient assistant to have access to and to provide care and/or treatment to a particular patient's body part that is positioned over the first left section or the second left section when the first left section or the second left section are inflated to rotate (turn) the patient and the other left section is (a) being inflated, (b) deflated or (c) being deflated;

controlling the inflation/deflation of one set of first and second sections so either the first or the second section is inflated or deflated so at least a portion of the patient that contacts the one set of first and second sections is exposed so that portion of the patient can be treated and cared for, while the other set of first and second sections is in the set position.

20. The therapeutic support of claim 1, further comprising cushion material positioned over opposing (a) first left and right sections or (b) second left and right sections.

* * * * *